US006644654B1

(12) United States Patent
Mao

(10) Patent No.: US 6,644,654 B1
(45) Date of Patent: Nov. 11, 2003

(54) SHEET ORDER GATE

(75) Inventor: Yanmin Mao, Brampton (CA)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/188,570

(22) Filed: Jul. 3, 2002

(51) Int. Cl.[7] ..... B65H 31/26

(52) U.S. Cl. ..... 271/220; 271/207; 271/177; 270/58.08; 270/58.12

(58) Field of Search ..... 271/207, 220, 271/177; 270/58.08, 58.12

(56) References Cited

U.S. PATENT DOCUMENTS

| | | | | |
|---|---|---|---|---|
| 3,220,724 | A | * 11/1965 | Von Ghlahn | 271/178 |
| 4,056,264 | A | * 11/1977 | Dhooge et al. | 271/177 |
| 5,058,880 | A | * 10/1991 | McGraw et al. | 271/315 |
| 5,409,202 | A | * 4/1995 | Naramore et al. | 270/58.12 |
| 5,692,740 | A | * 12/1997 | Holtje | 270/58.01 |
| 5,971,394 | A | * 10/1999 | Kida et al. | 271/303 |
| 6,209,864 | B1 | * 4/2001 | Taniguchi et al. | 271/220 |

FOREIGN PATENT DOCUMENTS

| | | | | |
|---|---|---|---|---|
| JP | 01226662 | A * 9/1989 | | B65H/31/26 |
| JP | 01261161 | A * 10/1989 | | B65H/29/22 |
| JP | 01313255 | A * 12/1989 | | B65H/31/06 |

* cited by examiner

*Primary Examiner*—Donald P. Walsh
*Assistant Examiner*—Matthew J Kohner
(74) *Attorney, Agent, or Firm*—Perman & Green, LLP

(57) ABSTRACT

A sheet stacking apparatus having an inclined tray for receiving sheets for stacking, and a sheet order gate for first guiding lead edges of each of the sheets that are being fed to the stack and for then guiding trail edges of each of the sheets positioned in the tray in their correct order is disclosed. The apparatus comprises a sheet order gate device having a plurality of control surfaces which form channels for moving the sheets therein, the control surfaces having a lowermost portion, each of the channels consisting of two control surfaces, the gate device adapted to rotate in segments, thereby rotating the control surfaces in segments, each segment adapted to position a lowermost control surface to force a trailing edges into the tray; and a sheet feeding device for feeding the sheets by their lead edges into the inclined tray such that the lead edges of each of the sheets rest on a backstop, and the trailing edges of each of the sheets are positioned at a level above the lowermost portions of the control surfaces.

10 Claims, 3 Drawing Sheets

SHEET ORDER GATE

BACKGROUND OF THE INVENTION

1. Field of the Invention

The present invention relates generally to a finishing apparatus that can be used, for example, with an electrophotographic printing machine, and more particularly, to a unique structure for a sheet order gate for use in such a finisher that addresses the issue of reliable guiding the lead edge of sheets that are fed into a compiler past the trail edge of compiled sheets.

2. Brief Description of Related Developments

In the field of on-line finishing of copy sheets, many attempts have been made in the past to fill the need for a system that will compile copy sheets within an output tray of a finisher without damaging the copy sheets or causing set disturbance to a set of sheets in the process, e.g., by using angled paddle wheels or side tampers that offset sheet sets. However, experience has shown that these methods of handling copy sheets within a finishing apparatus have not been entirely satisfactory especially when the finisher is used with printing machines that produce copy sheet sets for finishing at very high rates of productivity. In typical prior art type sheet stacking apparatus, there is a tendency to allow sheets, as they are being compiled in a finishing apparatus, to stack in an incorrect order. When assembling any document in a specific order, this lack of organization, i.e. lack of the ability to stack sheets in the correct order, will present a very major disadvantage.

SUMMARY OF THE INVENTION

In accordance with the specific features of the present invention there is provided a sheet stacking apparatus that will overcome the disadvantages of prior art systems as explained above by having an inclined tray for receiving sheets for stacking, and a sheet order gate for first guiding lead edges of each of the sheets that are being fed to the stack and subsequently for guiding trail edges of each of the sheets to the stack of sheets to be positioned in the tray in their correct order, the apparatus comprising, a sheet order gate device having a plurality of control surfaces which form channels for moving the sheets therein, the control surfaces having a lowermost portion, each of the channels consisting of two control surfaces, the gate device adapted to rotate in segments, thereby rotating the control surfaces in segments, each segment adapted to position a lowermost control surface to force a trailing edges into the tray; and a sheet feeding device for feeding the sheets by their lead edges into the inclined tray such that the lead edges of each of the sheets rest on a backstop, and the trailing edges of each of the sheets are positioned at a level above the lowermost portions of the control surfaces.

In accordance with other embodiments of the present invention there is provided a process for feeding and stacking sheets in an inclined tray in a correct order comprising the steps of feeding each of a series of sheets through channels each channel formed of two control surfaces, the control surfaces forming a portion of a sheet order gate allowing a lead edge of each sheet to fall within the tray such that the lead edge rests on a backstop in the tray, the position of the backstop being arranged to permit a trailing edge of each sheet to fall above a lowermost portion of the control surfaces and of a set of control surfaces; and forcing the trailing edge of each sheet against the tray by rotating the sheet order gate through a segment and causing the lowermost portions of the control surfaces to push the trailing edges into the tray.

BRIEF DESCRIPTION OF THE DRAWINGS

While the present invention will hereinafter be described in connection with preferred embodiments thereof, it will be understood that it is not intended to limit the invention to only those described embodiments. On the contrary, it is intended that the present invention cover all alternatives, modifications, and equivalents that may be included within the spirit of the present invention as defined by the appended claims. For a general understanding of the features of the present invention, reference is made to the following drawings. In the drawings, like reference numerals have been used throughout to designate identical elements.

DETAILED DESCRIPTION OF THE PREFERRED EMBODIMENT(s)

Figure 1:
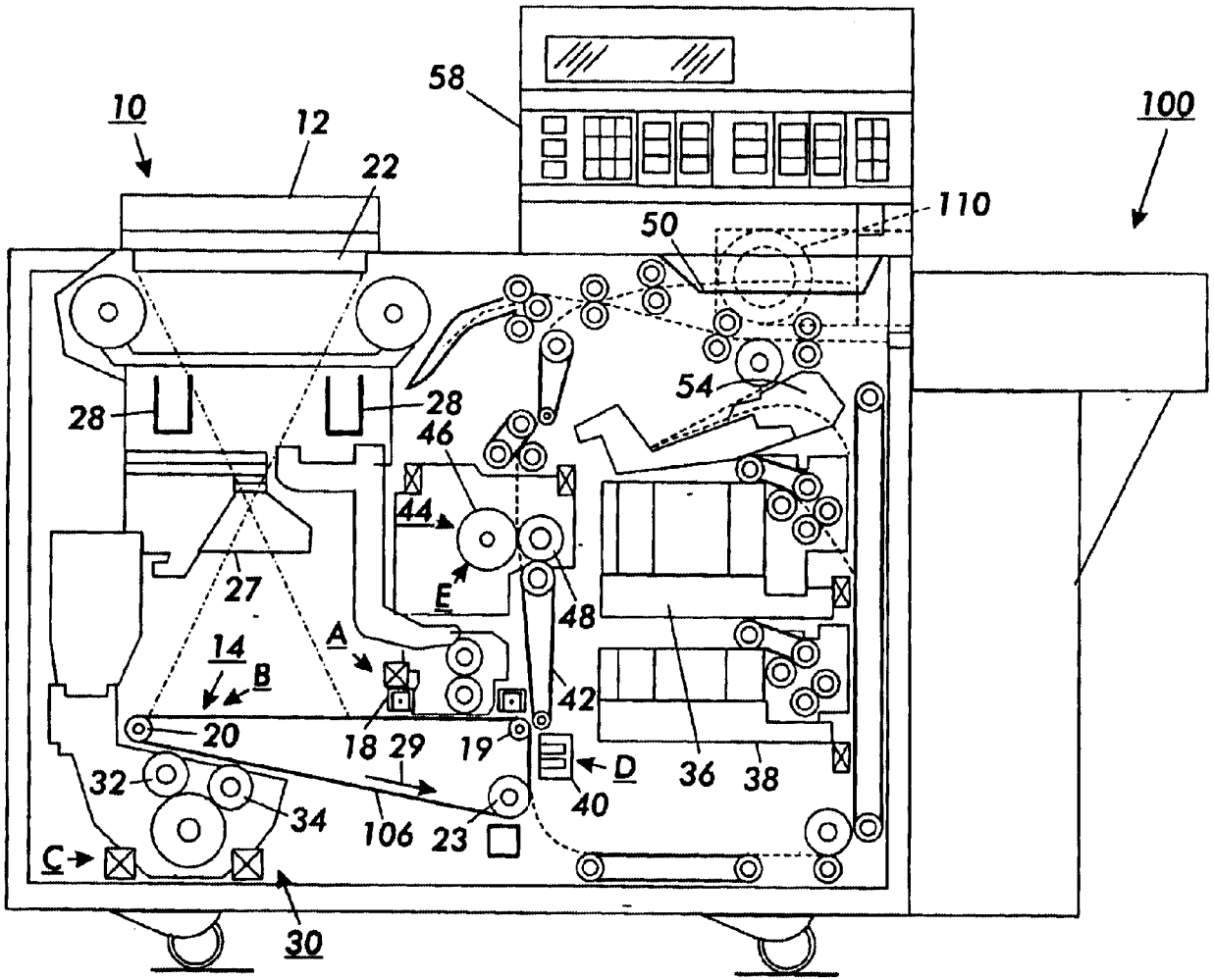
FIG. 1 is a schematic showing an electrophotographic machine feeding sheets to the improved finishing apparatus in accordance with the features of the present invention. It will become apparent however, from the following discussion that a finisher having the sheet order gate design in accordance with the features of the present invention, could be used with many different kinds of electrophotographic machines, and is not limited to only the embodiment shown herein.

A typical printing machine such as an electrophotographic printing machine as illustrated in FIG. 1 is an example of one of many of the different types of printing machines which can be used in conjunction with a finishing apparatus that can employ the specific features of the sheet order gate design as defined in accordance with the embodiments described herein.

Referring now particularly to FIG.1, there is illustrated a printing machine 10 that includes conventional controller 58 and a recirculating document handling system 12 for advancing successive original documents onto the platen 22 of the processing module 14. Inasmuch as the art of electrophotographic printing is well known, the operation of the various processing stations employed in processing module 14 will be described briefly for the purpose of explaining the general embodiment that the present invention can be used in.

Processing module 14 employs a belt 106 having a photoconductive surface disposed on a conductive substrate. Preferably the photoconductive surface is made from a selenium alloy with the conductive substrate being preferably made from an aluminum alloy which is electrically grounded. Belt 106 advances portions of the photoconductive surface sequentially through the various processing stations disposed about the path of movement thereof. Belt 106 is entrained about stripping roller 19, tensioning roller 20 and drive roller 23. Drive roller 23 is coupled to a suitable motor so as to rotate and advance belt 106.

Initially, a portion of belt 106 passes through charging station A. At charging station A, a corona generating device 18 charges the photoconductive surface of belt 106 to a relatively high, substantially uniform potential.

After the photoconductive surface of belt 106 is charged, the charged portion thereof is advanced through exposure station B. At exposure station B, an original document is advanced by the recirculating document handling system 12 to a transparent platen 22. Lamps 28 flash light rays onto the original document. The light rays reflected from the original document are transmitted through lens 27 forming a light image thereof. Lens 27 focuses the light image onto the charged portions of the photoconductive surface to selectively dissipate the charge thereon. This records an electrostatic image on the photoconductive surface of belt 106, which corresponds to the informational areas contained within the original document.

Thereafter, belt 106 advances the electrostatic latent image record of the photoconductive surface in the direction of arrow 29 to development station C. At development station C, a magnetic brush development system, indicated generally by the reference numeral 30, advances developer material into contact with the latent image. Preferably, magnetic brush development system 30 includes two magnetic brush developer rollers 32 and 34. Each roller advances developer material into contact with the latent image. These rollers form a brush of carrier granules and toner particles extending outwardly therefrom. The latent image attracts the toner particles from the carrier granules forming a toner powder image on the photoconductive surface of belt 106.

After the electrostatic latent image is developed, belt 106 advances the toner powder image to transfer station D. A sheet of support material is advanced to transfer station D from either copy sheet stack supporting apparatus 36 or 38. Transfer station D includes a corona generating device 40 which sprays ions onto the backside of the copy sheet. This attracts the toner powder image from the photoconductive surface to the copy sheet. After transfer, the copy sheet moves onto conveyor 42 which advances the sheet to fusing station E.

Fusing station E includes a fuser assembly, indicated generally by the reference numeral 44, which permanently affixes the transferred powder image to the copy sheet. Preferably, fuser assembly 44 comprises a heated fuser roller 46 and a back-up roller 48. The copy sheet passes between the fuser roller and back-up roller with the toner powder image contacting the fuser roller. In this manner, the toner powder image is permanently affixed to the copy sheet. After fusing, the copy sheet is either advanced to output tray 50, returned to duplex tray 54 for subsequent recycling so as to enable a toner powder image to be transferred to the other side thereof, or if compiling is required, directed into finisher 100. The detailed structure of the sheet order gate in accordance with the features of this invention as found in finisher 100, especially the details of the compiler within the finisher, will be described hereinafter with reference to FIGS. 2 and 3.

Figure 2:
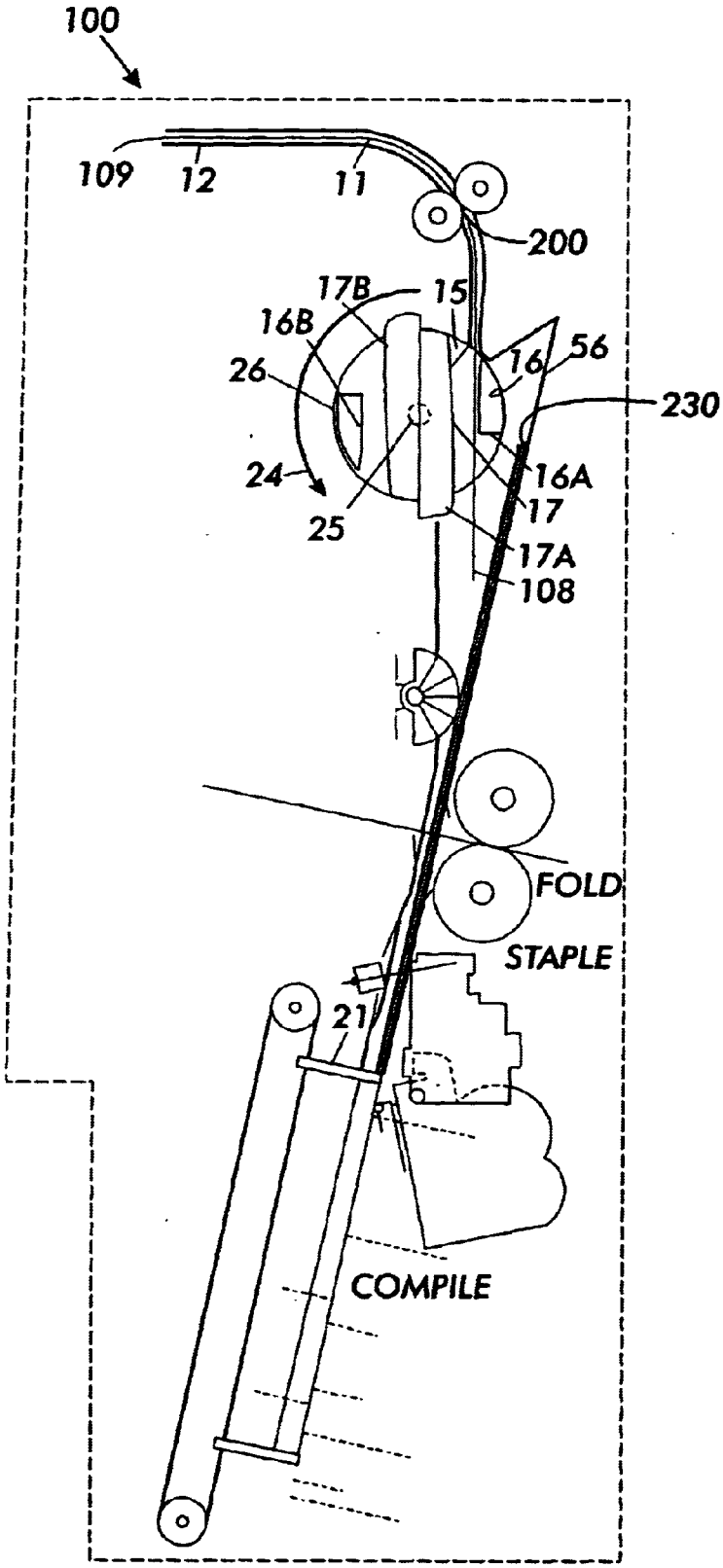
FIG. 2 is a sectional plan view of a sheet processing apparatus in a finisher, illustrating the use of a sheet order gate design in accordance with the features of the present invention.
Figure 3:
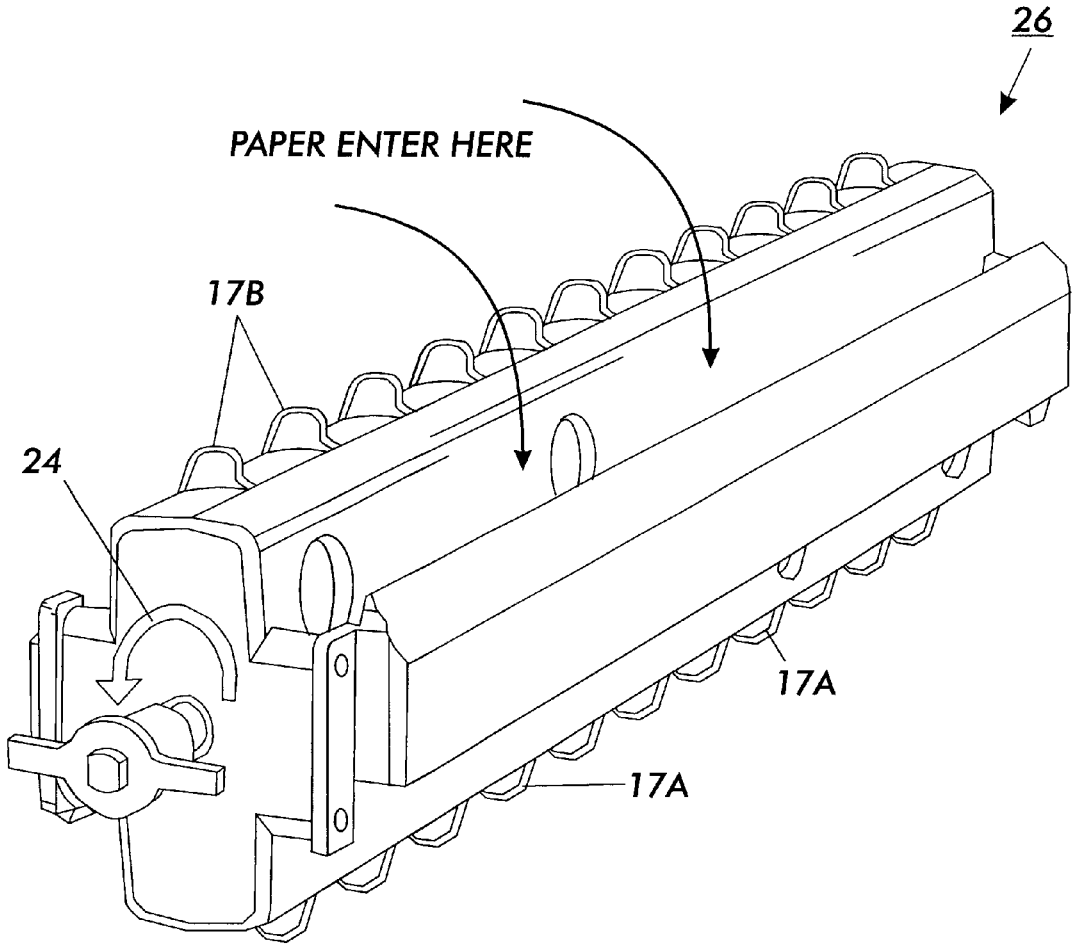
FIG. 3 is a perspective view of a sheet order gate in accordance with the features of the present invention.

In accordance with the preferred embodiments of the features of the present invention, and as illustrated in FIG. 2, paper sheets 11 which need to be stacked in a specific order, enter the finisher module 100 along feeding passage 12 and continue their travel until each sheet finds its way to an inclined stacker tray 56 used for stacking, each of the sheets 11. In the process of travelling to the inclined stacker tray 56, sheet 11 passes through a paper path channel 15. This channel is formed by two control surfaces 16 and 17 each having lowermost portions 16A and 17A. The lead edge 108 of a sheet 11 continues to travel into the inclined stacker tray 56 until the trailing edge 109 of the sheet 11 leaves the driving nip 200. At this point in the process, sheet 11 falls into the inclined stacker tray 56 such that the lead edge 108 of sheet 11 is now resting on backstop 21 which extends from tray 56. The position of the backstop 21 is intentionally arranged in tray 56 such that the trail trailing edge 109 of sheet 11 is positioned at a level above the lowermost control surfaces 16A and 17A. At this juncture the trailing edge 109 of sheet 11 must be forced to be positioned snugly on the tray 56 at 230 to avoid the next sheet (not shown) passing between sheet 11 and the rest of the sheets which have been already positioned within the inclined stacker tray 56.

In order to place the trailing edge 109 of sheet 11 at position 230 of tray 56, the control surfaces 16 and 17 in accordance with the features of the present invention are rotated in a counter clockwise direction as shown by arrow 24 about the center of the circle 25. This is basically the configuration of sheet order gate 26 as more specifically illustrated in FIGS. 2 and 3. The rotation action moves the lower point of control surface 17 (specifically the region identified as 17A) towards area 230 on tray 56.

The arrangement of control surfaces 16 and 17 on sheet order gate 26 is mirror imaged by control surfaces 16B and 17B such that each time the sheet order gate 26 rotates one segment (i.e. preferably about 180°) the lowermost portions of control surfaces 17 and 17B force the trailing edge 109 of a sheet 11 snugly onto tray 56 so as to avoid the next sheet in the series of sheets being fed to tray 56 from passing between the sheet being fed and the sheets already positioned on tray 56. If this were to happen, the sheets would not be in their correct order in, for example, a book which is being put together. This would mean that, for example, page 31 of the book would be positioned before page 30. Moving the sheet order gate 26 in a rotating manner in segments such as segments of 180 degrees each is preferably done by an electronic controller employing a stepper motor (not shown). This arrangement of control surfaces 16, 17 and 16B, 17B, would keep returning to their original position with a rotation angle of 360 degrees, i.e. a turning segment of 360 degrees.

For the reason of having a more efficient sheet order gate 26, i.e. to save time with regard to the rotation cycle, the second set of control surfaces 16B and 17B are placed at a position 180 degrees from control surfaces 16 and 17 thereby reducing the total cycle time for the sheet order gate by 50%. Of course it is within the scope of the features of the present invention to have rotational segments other than 180 degrees, e.g. 90 degrees.

The sheet order gate design concept in accordance with the present invention can be used, for example in a finisher apparatus that utilizes a modular strategy which enables the finisher to provide many optional configurations and on-line features. A specific example of one of these configurations is a high capacity stapler stacker finisher, which can operate at 35, 45 or 55 pages per minute. This kind of finisher can offer a 250 sheet capacity top bin; two 1500 sheet high capacity bins; single dual, multiple and 45° stapling of up to 50 sheets; set offsetting to high capacity bins; 45° stapling of up to 50 sheets; set offsetting to high capacity bins; 45° offline convenience stapling (walk-up staple); online hole punch (either 2, 3 or 4 hole configurations); and booklet making (fold and stitch up to 15 sheets). The finisher can perform non-offset and offset stacking as well as set stapling operations on pages delivered from a processor to the finisher in accordance with the selected finishing mode and location.

Various options can be used with the finisher described above that can include providing enhanced job set finishing functions. For example, stapling and/or other binding, punching, folding, special sheet inserts or booklet making, and mailbox sorting of either the finished or unfinished sets. Another option is to provide a universal output device (mailbox, finisher, high capacity stacker or sorter) which may include simple and/or common bin or tray mounting/removal means for changing the number, spacing, position and type of the bins, and/or so as to permit the device to operate as a high capacity elevator/stacker and/or as a sorter, for a copier or printer, and/or as a multiple bin mailbox or sorter for a copier or printer, or variable combinations thereof. The user can optionally determine the desired number, location and capacity of the bins and/or stacking trays for a particular desired configuration. Also, various mailbox features, i.e. features relating to the handling or sorting of physical hard copy, can be used such as, for example, to provide a modular integral unit for improved handling and organizing the sequential sheets output of a wide variety of printer, copiers and/or facsimile machines or combinations or multifunction "combo" units thereof, especially shared user and/or electronically connected interoffice "system" printer units.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A sheet stacking apparatus having an inclined tray for receiving sheets for stacking, and a sheet order gate for first guiding lead edges of each of the sheets that are being fed to the stack and subsequently for guiding trail edges of each of the sheets to the stack of sheets to be positioned in the tray in their correct order, the apparatus comprising:

a sheet order gate device having a plurality of control surfaces which form channels for moving the sheets therein, the control surfaces having a lowermost portion, each of the channels consisting of two control surfaces, the gate device adapted to rotate in segments thereby rotating the control surfaces in segments, each segment adapted to position a lowermost control surface to force a trailing edges into the tray; and a sheet feeding device for feeding the sheets by their lead edges into the inclined tray such that the lead edges of each of the sheets rest on a backstop, and the trailing edges of each of the sheets are positioned at a level above the lowermost portions of the control surfaces, wherein each of said segments is 180 degrees.

2. A sheet stacking apparatus according to claim 1, wherein said apparatus is positioned within a finisher apparatus.

3. A sheet stacking apparatus according to claim 2, wherein said finisher apparatus is a booklet maker.

4. A sheet stacking apparatus according to claim 2, wherein said finisher is a modular apparatus and the finisher module is connected to an electrophotographic printing module.

5. A sheet stacking apparatus according to claim 1, wherein said backstop is positioned within said tray to cause said trailing edge of each sheet to be positioned at a level above said lowermost control surface.

6. A sheet stacking apparatus according to claim 1, wherein said rotatable sheet order gate is rotated by a stepper motor.

7. A sheet stacking apparatus having an inclined tray for receiving sheets for stacking, and a sheet order gate for first guiding lead edges of each of the sheets that are being fed to the stack and subsequently for guiding trail edges of each of the sheets to the stack of sheets to be positioned in the tray in their correct order, the apparatus comprising:

a sheet order gate device having a plurality of control surfaces which form channels for moving the sheets therein, the control surfaces having a lowermost portion, each of the channels consisting of two control surfaces, the gate device adapted to rotate in segments thereby rotating the control surfaces in segments, each segment adapted to position a lowermost control surface to force a trailing edges into the tray; and a sheet feeding device for feeding the sheets by their lead edges into the inclined tray such that the lead edges of each of the sheets rest on a backstop, and the trailing edges of each of the sheets are positioned at a level above the lowermost portions of the control surfaces, wherein said sheet order gate includes two sets of control surfaces, each set being a mirror image of the other set.

8. A process for feeding and stacking sheets in an inclined tray in a correct order comprising the steps of:

feeding each of a series of sheets through channels, each channel formed of two control surfaces, the control surfaces forming a portion of a sheet order gate;

allowing a lead edge of each sheet to fall within the tray such that the lead edge rests on a backstop in the tray, the position of the backstop being arranged to permit a trailing edge of each sheet to fall above a lowermost portion of the control surfaces of a set of control surfaces; and forcing the trailing edge of each sheet against the tray by rotating the sheet order gate through a segment and causing the lowermost portions of the control surfaces to push the trailing edges into the tray.

9. A process for feeding and stacking sheets in accordance with claim 8, wherein said segment of rotation is about 180 degrees.

10. A process for feeding and stacking sheets in accordance with claim 8, wherein rotating said sheet order gate positions a second set of control surfaces to force a trailing edge of a subsequent sheet against said tray.

* * * * *